United States Patent [19]

Fortner

[11] 3,979,066

[45] Sept. 7, 1976

[54] GOVERNOR FOR ROTARY SPRINKLER

[75] Inventor: Bennie Fortner, Covina, Calif.

[73] Assignee: Rain Bird Sprinkler Mfg. Corporation, Glendora, Calif.

[22] Filed: July 1, 1975

[21] Appl. No.: 592,165

[52] U.S. Cl. ..... 239/252; 239/256

[51] Int. Cl.[2] ..... B05B 3/06

[58] Field of Search ..... 239/230, 231, 232, 233, 239/251, 252, 256, 258, 237

[56] References Cited

UNITED STATES PATENTS

| | | | |
|---|---|---|---|
| 270,664 | 1/1883 | Henderson et al. | 239/251 X |
| 1,901,225 | 3/1933 | Butler | 239/233 |
| 3,664,586 | 5/1972 | Harris, Sr. | 239/233 |

*Primary Examiner*—John J. Love

*Attorney, Agent, or Firm*—Fulwider, Patton, Rieber, Lee & Utecht

[57] ABSTRACT

A rotary irrigation sprinkler having a rotating body carrying nozzle arms and nozzles for ejecting water streams and including a reaction vane adapted to control and reduce the speed of rotation of the sprinkler to increase the useful life of the sprinkler and also increase the effective area irrigated.

11 Claims, 9 Drawing Figures

GOVERNOR FOR ROTARY SPRINKLER

BACKGROUND OF THE INVENTION

This invention relates to rotary sprinklers of the type primarily intended for plant irrigation and more particularly, to a governor device for controlling the speed of rotation of such sprinklers.

The speed of rotation of a rotary sprinkler is determined by the forward drive forces tending to rotate the sprinkler, and the inherent retarding forces such as friction and the like which tend to reduce rotational speed. In most rotary sprinklers, for example full circle sprinklers of the reaction drive type, the speed of rotation is usually quite high. With a high speed of rotation, greater friction forces will be developed within the sprinkler and substantial wear of parts within the sprinkler will result. Further, the greater the speed of rotation, the less will become the effective area that the sprinkler will irrigate since water from the sprinkler will tend to spiral and travel less distance from the sprinkler before fall out.

To reduce friction, and therefore increase the effective life of a rotary sprinkler, it is desirable that the speed of rotation be controlled and reduced to relatively low levels. Moreover, by controlling and reducing the speed of rotation, the area irrigated by the sprinkler can be increased.

SUMMARY OF THE INVENTION

The present invention provides a governor device for rotary sprinklers and which is reliable and effective in controlling and reducing the rotational speed of the sprinkler thereby to increase the useful life of the sprinkler and increase the size of the area irrigated by the sprinkler. Further, the governor of the invention is relatively simple in structure, and requires no moving parts when in use to reduce the speed of sprinkler rotation.

More specifically, the governor includes a reaction vane which is normally disposed out of the path of the stream ejected by the sprinkler when the sprinkler is not rotating, but which will be hit by the stream when the sprinkler rotates above a desired speed to produce a reverse torque and slow the rate of sprinkler rotation. Moreover, the location of the vane can be selected to increase or decrease the speed of sprinkler rotation within relatively wide ranges.

In one embodiment, the vane is secured to an arm attached to the sprinkler for rotation therewith, and is adjustable by a simple mechanism to project laterally toward the stream path of water ejected by one of the spray nozzles. By selecting the lateral location of the vane relative to the stream path, the speed of sprinkler rotation can be controlled.

In another embodiment, the vane is adjustably mounted to the sprinkler and controls the speed of rotation by moving the vane to a selected position longitudinally along the stream path of water ejected by one of the nozzles of the sprinkler. In a third disclosed embodiment, the vane comprises a fixed non-adjustable channel extending from one of the nozzles of the sprinkler, and which operates in a reliable and effective manner to slow sprinkler rotation for prolonged life and increased area of coverage.

Many other features and advantages of the present invention will become apparent from the following description taken in conjunction with the accompanying drawings which disclose, by way of example, the principles of the invention.

DETAILED DESCRIPTION OF THE DRAWINGS

DETAILED DESCRIPTION

Figure 1:
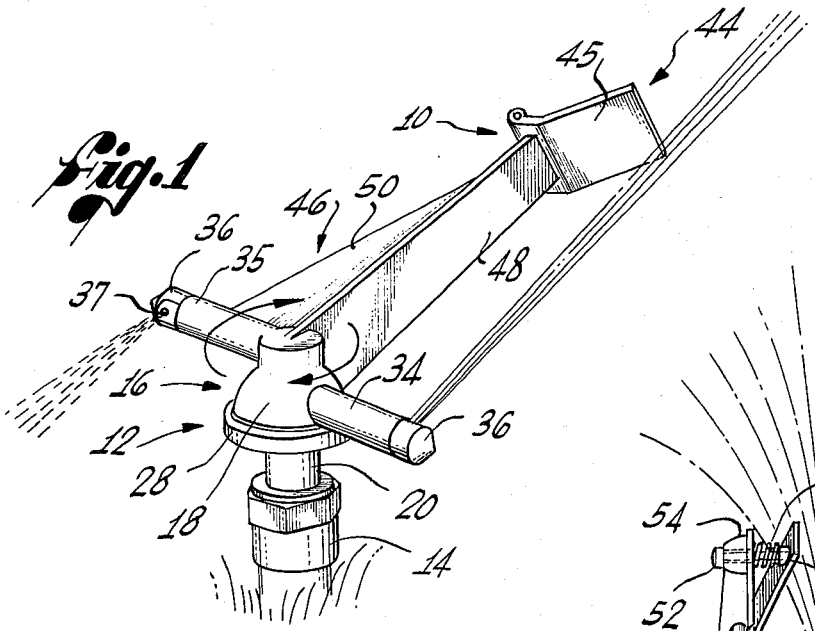
FIG. 1 is a perspective view of a rotary sprinkler having a governor device embodying the principles of the present invention.

As shown in the exemplary drawings, the present invention is embodied in a governor device 10 for controlling the speed of rotation of a rotary sprinkler 12 of the type primarily intended for use in irrigating plants. In this instance, the sprinkler 12 is mounted above the ground on a supply pipe or riser 14 for rotation about a generally vertical axis, and is driven by the reaction force of the water ejected from the sprinkler to rotate continuously in a clockwise direction as viewed in FIG. 1. Although the present invention is herein described in connection with full-circle, reaction drive type sprinklers, it should be appreciated that this invention can be equally used with other types of rotary sprinklers.

With reference to the embodiment of the invention illustrated in FIGS. 1 through 4, the sprinkler 12 which herein is formed from molded plastic, includes a body 16, comprising an inverted, generally cup shaped housing 18 rotatably supported about the upper end portion of an open ended tubular sleeve 20 threadably secured at its lower end to the upper end portion of the riser 14. The housing 18, has a closed, upper end 22, supported on the upper end 24 of the sleeve 20 to prevent downward movement of the housing relative to the sleeve, and a lower, threaded skirt portion 26 to which is threaded a collar 28 having a radially inwardly projecting lip 30 which underlies a circumferential flange 32 formed around the sleeve to prevent the housing from moving upwardly relative to the sleeve. Interposed between the upper surface of the lip 30 and the lower surface of the flange 32 is a bearing washer 31 for facilitating relative rotation of the housing 18 about the sleeve 20.

Projecting horizontally from diametrically opposite sides of the housing 18 and formed integrally therewith, are two tubular nozzle arms 34 and 35 to which are attached spray nozzles 36 having laterally and slightly upwardly oriented spray openings 37 for ejecting water in a direction generally tangentially of the axis of rotation of the sprinkler 12. As can best be seen in FIGS. 1 and 3, the nozzle arms 34 and 35 are in this instance vertically offset, the nozzle arm 35 projecting to the left in FIG. 3 extending laterally from the upper end portion of the housing 18 adjacent the closed end 22, and the nozzle arm 34 projecting to the right being formed intermediate the upper end portion of the housing and the lower skirt portion 26.

Figure 3:
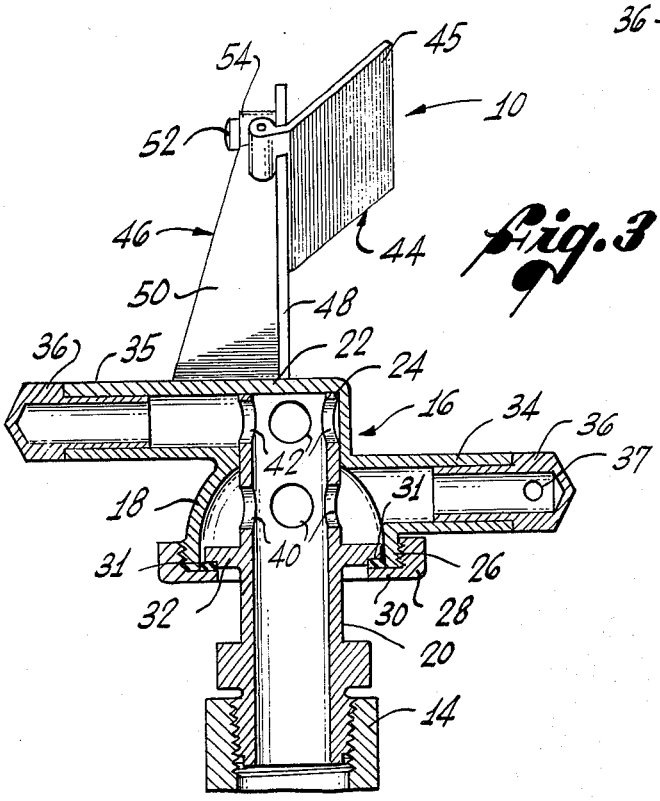
FIG. 3 is an enlarged fragmentary cross-sectional view taken substantially along line 3—3 of FIG. 2.

For communicating water from the riser 14 to the nozzles 36, the sleeve 20 has two sets of laterally directed ports 40 and 42 opening into the housing 18. As shown in FIG. 3, each set of ports 40 and 42 comprises four uniformly spaced openings of circular cross-section, the lower ports 40 being generally vertically aligned with the center line of the nozzle arm 34 extending to the right, and the upper ports 42 being generally vertically aligned with the center line of the nozzle arm 35 extending to the left.

When water under pressure is initially supplied through the riser 14 and sleeve 20, an upward force is created by the water within the sleeve 20 acting through the open upper end of the sleeve against the closed end 22 of the housing 18 to raise slightly the housing relative to the sleeve. This produces a compression of the bearing washer 31 between the lip 30 of the collar 28 and the flange 32 of the sleeve 20 to provide a tight fluid seal with the housing 18 and reduce friction within the sprinkler 14 by raising the closed end 22 of the housing above the upper end 24 of the sleeve during rotation.

The ungoverned speed of the rotary sprinkler 12 is controlled by the amount of driving torque created by the water ejected from the nozzles 36 balanced against the rotation retarding forces such as friction in the bearing 31, and the like. As the sprinkler 12 rotates, the columns or streams of water ejected from the nozzles 36 appear to bend to form helical spirals which expand outwardly away from the sprinkler. Since the nozzles 36 are rotating in a forward direction, the speed of the nozzles will cause the water particles in the stream to fall out earlier than if ejected from a similar non-rotating nozzle. Moreover, the faster the speed of rotation of the sprinkler 12, the greater will be the spiral of the stream path ejected by the nozzles 36, and the less the effective area that will be covered by the sprinkler.

In accordance with the present invention, the governor 10 is attached to the sprinkler 14 to reduce and control the speed of rotation of the sprinkler thereby increasing the distance water is thrown from the sprinkler and thus increasing the effective area irrigated. Further, the governor 10 operates in a reliable and effective manner, is simple in construction, and functions to significantly prolong the useful life of the sprinkler 12.

Toward the foregoing ends, the governor 10 comprises a generally rectangular shaped reaction slate or vane 44 secured to the housing 18 for rotation therewith, and which is normally disposed to be spaced from and out of the path of the water stream ejected by the nozzles 36, but which will be hit by the stream to produce a reverse torque and slow down rotational speed when the sprinkler is rotating faster than the desired speed. The vane 44, which requires no moving parts when in operation, produces a reverse torque which is directly proportional to the rotational speed of the sprinkler 12 to reduce and control the speed of rotation to substantially any desired rate.

Figure 2:
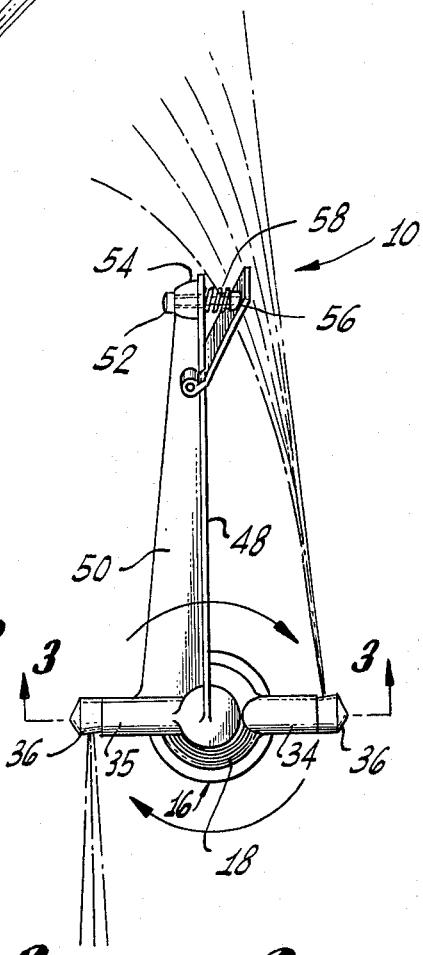
FIG. 2 is a top plan view of the sprinkler of FIG. 1 and including a diagrammatic representation of various water stream conditions during rotation of the sprinkler.

More specifically, the vane 44 is disposed adjacent the path of the water stream ejected by one nozzle 36, herein the right side nozzle as viewed in FIG. 2, so as to produce, when hit by the stream, a torque on the housing 18 in a direction opposite that created by the nozzles. The vane 44 has a generally flat reaction surface 45 which is disposed to face in the direction of rotation of the body 18, and be out of the path of the stream when the sprinkler 12 is not rotating or when rotating at a speed below the desired speed, but which will be hit by the stream due to the spiral path of the stream when the speed of the sprinkler exceeds the desired speed. By selecting the position of the vane 44 relative to the stream, the speed of rotation of the sprinkler 12 can be effectively controlled within wide ranges.

Figure 4:
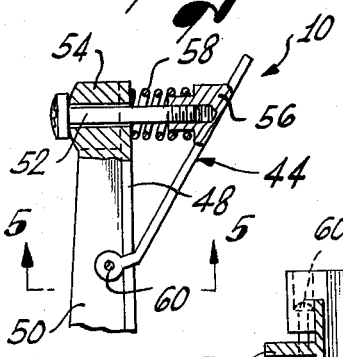
FIG. 4 is an enlarged fragmentary cross-sectional view of the governor device of FIG. 2.

With reference primarily to FIGS. 1, 2, and 4, it can be seen that the vane 44 is therein mounted adjacent the outer end of a support bracket 46 which is formed integrally with the housing 18 to project outwardly and upwardly from the housing between the nozzle arms 34 and 35 in generally parallel relation to the stream ejected by the nozzle 36 attached to the right side nozzle arm 34 ahead of the vane. The support bracket 46 comprises a generally rectangular shaped mounting arm 48 extending laterally from the side of the housing 18 along a line perpendicular to the centerlines of the nozzle arms 34 and 35, and an elongated reinforcing strut 50 which extends from the side portion of the upper or left nozzle arm 35, as viewed in FIGS. 1 and 2, along the length of the mounting arm 48.

Figure 5:
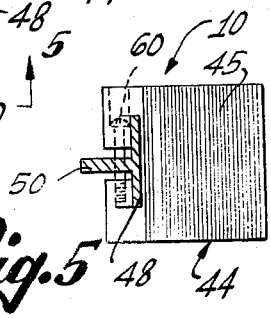
FIG. 5 is a cross-sectional view taken substantially along line 5—5 of FIG. 4.

As can be seen in FIGS. 4 and 5, the vane 44 is pivotably attached at one end, the left end in FIG. 4, to the bracket 46 so that the free end projects obliquely away from the mounting arm 48 and toward the path of the stream ejected by the nozzle 36 immediately ahead of the vane. In this instance, the left end of the vane 44 in FIG. 4 is pivotably attached to the bracket 46 by a screw 60 which extends through a hole formed in the strut 50, as best shown in FIG. 5.

To control the amount by which the vane 44 projects obliquely from the bracket 46 toward the stream, a headed screw 52 projects through a boss 54 formed on the outer end portion of the bracket, and into a threaded sleeve 56 attached to the side of the vane adjacent the bracket. By adjustment of the screw 52, the free end of the vane 44 can be moved toward or away from the bracket 46, a compression spring 58 being herein interposed between the vane and the mounting arm around the screw to pull the screw and hold it firmly in position through the boss 54.

As diagrammatically illustrated in FIG. 2, since the amount of spiral stream motion increases with increasing rotational speed, by adjusting the oblique angle of the vane 44 relative to the bracket 46 and thus, the space between the vane and the stream, the speed of rotation of the sprinkler 12 necessary for the stream from the nozzle 36 ahead of the vane to have sufficient spiral path motion to hit the vane can be controlled. Thus, by adjusting the vane 44 so that it is very close to the stream path when the sprinkler 12 is not rotating, a relatively slow rotational speed can be maintained, and conversely, a vane position substantially away from the straight line stream position will require a much greater rotational speed before the stream will have sufficient spiral path motion to hit the vane and produce a reverse torque to slow down the sprinkler.

Figure 6:
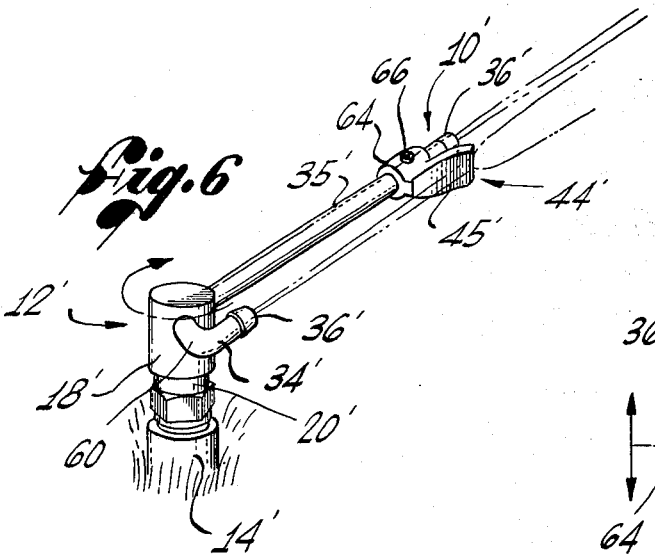
FIG. 6 is a perspective view of another embodiment of a rotary sprinkler having a governor device embodying the principles of the present invention.
Figure 7:
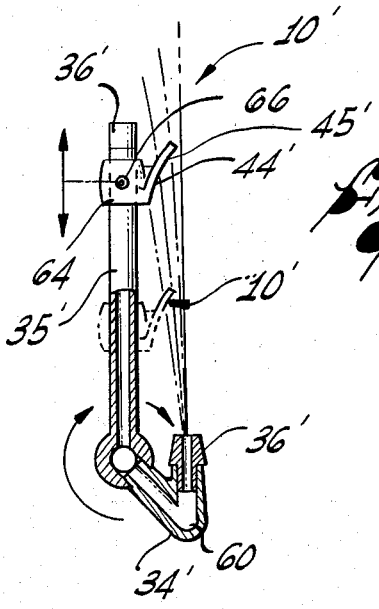
FIG. 7 is a top plan view, partly in cutaway cross-section, of the sprinkler of FIG. 6 and including a digrammatic representation of various water stream conditions during rotation of the sprinkler.

Illustrated in FIGS. 6 and 7 is another embodiment of a sprinkler 12′ employing the principles of the present invention, with reference numerals thereon corresponding to similar parts previously described in connection with the embodiment of FIGS. 1 through 6 being designated by corresponding primed reference numerals. In this instance, the vane 44′ of the governor 10′ is adjustable by controlling the position of the vane longitudinally along the stream path rather than laterally, as in the embodiment of FIGS. 1 through 5.

More specifically, the sprinkler 12′ includes a pair of spray nozzles 36′ attached to the ends of a pair of nozzle arms 34′ and 35′ projecting from a housing 18′ rotatably supported on a sleeve 20′ secured to a riser 14′. The nozzle arms 34′ and 35′ herein comprise one elongated tubular arm 35′ projecting radially from the housing 18′ and having its nozzle 36′ ejecting a stream of water in a direction radially of the axis of sprinkler rotation, and a second nozzle arm 34′ projecting outwardly from the housing at an oblique angle to that of the first nozzle arm, and bent to eject its stream in a direction generally parallel to and along side that of the first nozzle arm, the reaction force for driving the sprinkler 12′ being herein created by the force of water passing through the second nozzle arm and around an elbow portion 60 thereof to the nozzle.

The vane 44′ herein comprises a laterally projecting, fixed plate having a generally flat reaction surface 45′ and is secured to a tubular sleeve 64 slidably engaged around the first nozzle arm 35′ which serves as the mounting bracket. A friction locking screw 66 extends through the sleeve 64 and upon tightening, will frictionally grip the outer surface of the first nozzle arm 35′ to lock the sleeve in the desired position along the length of the nozzle arm.

To control the speed of rotation of the sprinkler 12′, the vane 44′ is positioned at the desired location along the first nozzle arm 35′ to be hit by the stream from the nozzle 36′ of the second, drive producing nozzle arm 34′. As diagrammatically illustrated in FIG. 7, since the amount or degree of bend of the stream ejected by the nozzles 36′ increases outwardly from the nozzle along the stream path, by moving the vane 44′ closer to the nozzle 36′ of the second nozzle arm 34′, greater rotational speed will be required before the water from that nozzle will hit the vane than if the vane were disposed further away from that nozzle. Thus, the speed of rotation of the sprinkler 12′ can be readily controlled simply by adjusting the position of the vane 44′ along the nozzle arm 35′.

Figure 8:
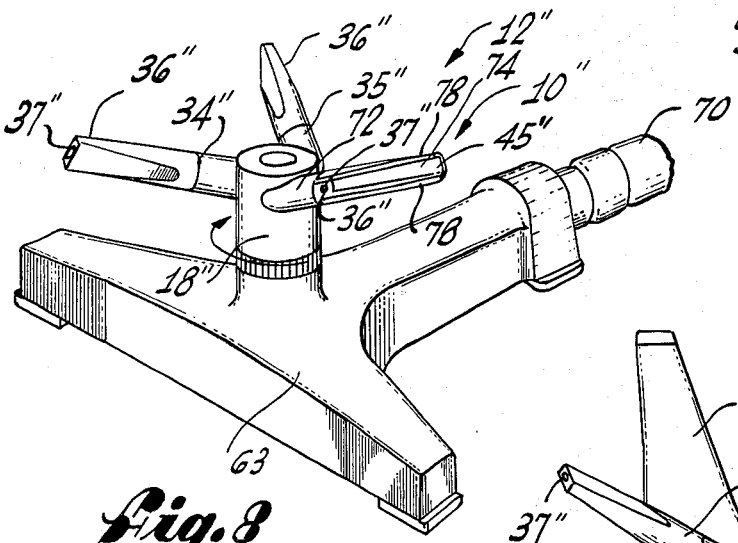
FIG. 8 is a perspective view of a further embodiment of a rotary sprinkler having a governor device embodying the principles of the invention.
Figure 9:
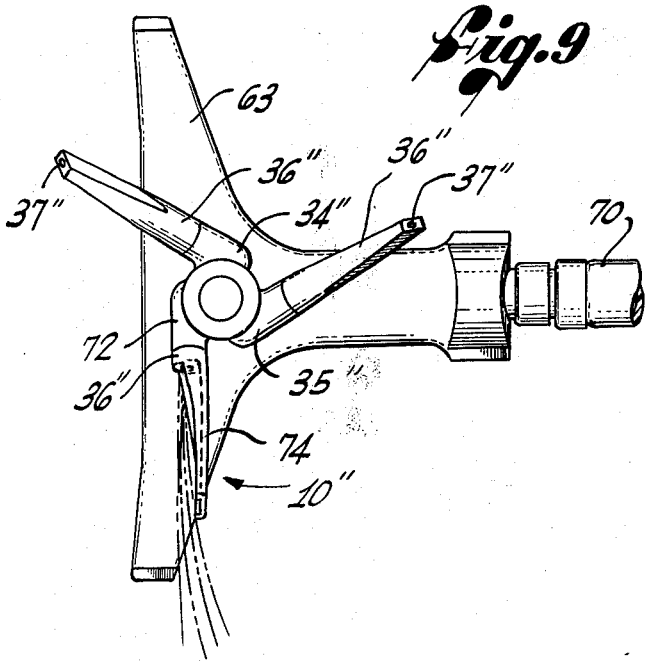
FIG. 9 is a top plan view of the sprinkler of FIG. 8 and including a diagrammatic representation of various water stream conditions during use of the sprinkler.

Illustrated in FIGS. 8 and 9 is another sprinkler 12″ embodying the principles of the present invention, in this instance a governor 10″ which is not adjustable. As in the previous discussion of the embodiment of FIGS. 6 and 7, reference numerals for parts having a structure or function similar to those discussed in connection with the embodiment of FIGS. 1 through 5 have been designated by corresponding double primed reference numerals.

As can be seen in FIGS. 8 and 9, the sprinkler 12″ comprises a body 16″ mounted for rotation on a support base 68 connected to a supply hose 70, the body being rotatably supported on an internal sleeve which is not shown in the drawings. In this case, there are three nozzle arms 34″, 35″ and 72, each supporting a spray nozzle 36″ having a discharge opening 37″. As shown in FIG 9, the governor 10″ is formed as an extension of the spray nozzle 36″ of the lower nozzle arm 72, the nozzle being formed to be considerably shorter than those of the other nozzle arms 34″ and 35″ for aesthetic purposes.

The governor 10″ is herein formed by an elongated channel 74 of generally U-shaped cross-section having a generally flat reaction surface 45′ with outwardly projecting sides 78 opening toward and generally parallel to the stream path ejected by the nozzle 36″, the reaction surface being formed to bend slightly laterally toward the stream path between the nozzle 36′ and the end of the channel. The reaction surface 76 of the channel 74 is disposed to extend along the side of the stream path so that when the sprinkler 12″ is not rotating, the stream will not hit the governor 10″.

However, as the stream bends during the rotational movement of the sprinkler 12″, the stream from the nozzle 36″ attached to the nozzle arm 72 will hit the channel 74 to produce a reverse thrust to slow down the sprinkler. The faster the sprinkler 12″ rotates, the greater will be the reverse thrust created since more and more of the stream will bend and hit the channel 74. When the reverse force created by stream impact on the channel 74 combined with the other rotation retarding forces equal the forward reaction force created by water flow through the nozzle arms 34″, 35″ and 72, the sprinkler 12″ will rotate at a relatively slow but constant speed.

While several specific embodiments of the invention have been illustrated and described, it will also be apparent that various modifications and changes therein can be made without departing from the spirit and scope of the invention as defined by the appended claims.

In an actual test of a sprinkler similar to that illustrated in FIGS. 8 and 9 and employing straight bore nozzles 36″ having openings 37″ of a diameter of 5/32 inch operating under a supply pressure of 40 psi, it was found that the rotational speed was reduced from 510 RPM without the governor 10″ in operation, to 92 RPM with the governor in operation. The test was conducted by placing the channel 74 on the side of the nozzle arm 72 ahead of the nozzle 36″ in the direction of rotation of the arm to determine the ungoverned speed, and then returning the governor to the normal position shown in FIGS. 8 and 9, behind the stream to determine the governed speed. In this manner, weight and air resistance remained the same during both the governed and ungoverned tests.

By slowing the speed or rotation, a substantial reduction in the friction forces within a sprinkler can be achieved. This, of course, will reduce wear and increase the useful life of the sprinkler. Further, an increase in the size of the area irrigated will result at lower rotational speeds, thus making the sprinkler more effective. By way of example, in the test referred to above, the governed sprinkler 12″ irrigated an area approximately eleven percent greater than that irrigated by the ungoverned sprinkler.

From the foregoing, it should be apparent that the present invention provides a reliable and effective governor for controlling and reducing the speed of rotation of a rotary sprinkler thereby to increase useful life and the size of the effective area irrigated. Moreover, the governor 10 of the present invention requires no moving parts when in use, and is simple and trouble free in structure and operation.

I claim:

1. In a reaction drive rotary sprinkler of the type primarily intended for use in irrigating plants, and which includes a body supported for rotation in one direction, at least one spray nozzle attached to said body for rotation therewith and disposed to eject a water stream having a velocity component in a tangential direction relative to the axis about said body rotates whereby a reaction torque for rotating said body in said one direction produced, the improvement comprising:

governor means for controlling the speed of rotation of said body and attached to said body for rotation therewith, said governor having a reaction means disposed to be laterally spaced from the path of the stream ejected from said nozzle when said body is rotating at or below a preselected speed in said one direction, and to be hit by said stream when said body is rotating in said one direction above said preselected speed, said reaction means when hit by said stream imparting to said body a reverse reaction torque to control and slow the speed of rotation of said body in said one direction.

2. The improvement as defined in claim 1 in which said reaction means comprises a generally flat surface projecting laterally toward said stream path, said surface being disposed to face in the direction of rotation of said sprinkler in said one direction and adjacent the side of said stream path.

3. The improvement as defined in claim 2 in which said reaction means is adjustable relative to said stream path.

4. The improvement as defined in claim 1 in which said reaction means comprises a vane having a generally flat reaction surface projecting obliquely toward said stream path, and means for adjustably mounting said vane relative to said body and said stream path.

5. The improvement as defined in claim 4 including a mounting bracket projecting outward from said body in generally parallel relation to said stream path, and said vane comprising a generally flat plate pivotally attached at one end to said bracket and projecting obliquely away from said bracket toward said stream path, said vane being adjustable by pivoting said vane relative to said bracket to select the space between said stream path and said vane when said body is not rotating in said one direction.

6. The improvement as defined in claim 4 in which said vane is adjustable longitudinally along said stream path toward and away from said body.

7. A reaction drive rotary sprinkler of the type primarily intended for use in irrigating plants, said sprinkler comprising:

a body mounted for rotation in one direction;

at least one nozzle arm projecting laterally from said body;

a nozzle attached to the end of said nozzle arm remote from said body and disposed to eject a water stream having a velocity component in a tangential direction relative to the axis about which said body rotates, whereby a reaction torque for rotating said body in said one direction is produced; and governor means for controlling the speed of rotation of said body in said one direction, said governor means including a reaction vane coupled with said body for rotation therewith and disposed to be laterally spaced from the path of the stream ejected by said nozzle when said body is rotating at or below a preselected speed in said one direction, and to be hit by said stream when said body is rotating above said preselected speed in said one direction, said reaction vane when hit by said stream imparting to said body a reverse reaction torque to control and slow the speed of rotation of said body in said one direction.

8. A rotary sprinkler as defined in claim 7 in which said reaction vane includes a generally flat reaction surface projecting obliquely toward said stream, said vane being adjustable to select the speed of reaction of said body at which said reaction surface is hit by said stream.

9. A rotary sprinkler as defined in claim 8 in which said vane is adjustable by controlling the space between said vane and the path of said stream when said body is not rotating in said one direction.

10. A rotary sprinkler as defined in claim 8 in which said vane is adjustable by controlling the position of said vane longitudinally along the path of said stream ejected by said nozzle.

11. A rotary sprinkler as defined in claim 1 in which said vane comprises an elongated channel projecting outwardly from said nozzle and having a generally flat reaction surface extending along the side of said path of said stream, said reaction surface being disposed to face in the direction of rotation of said body when said body is rotating in said one direction.

* * * * *

PO-1050
(5/69)

UNITED STATES PATENT OFFICE
CERTIFICATE OF CORRECTION

Patent No. 3,979,066 Dated September 7, 1976

Inventor(s) Bennie Fortner

It is certified that error appears in the above-identified patent and that said Letters Patent are hereby corrected as shown below:

Column 8, line 41, (Claim 11), "claim 1" should be --claim 7--.

Signed and Sealed this
Fourteenth Day of December 1976

[SEAL]

*Attest:*

RUTH C. MASON
*Attesting Officer*

C. MARSHALL DANN
*Commissioner of Patents and Trademarks*